US005819142A

United States Patent [19]

Murata et al.

[11] Patent Number: 5,819,142

[45] Date of Patent: Oct. 6, 1998

[54] CHARGING MEMBER AND IMAGE-FORMING UNIT HAVING THE SAME

[75] Inventors: Jun Murata, Kawagoe; Yoshiaki Nishimura, Tokyo; Akiya Kume; Hiroshi Mayuzumi, both of Kawasaki, all of Japan

[73] Assignee: Canon Kaubshiki Kaisha, Tokyo, Japan

[21] Appl. No.: 855,392

[22] Filed: May 13, 1997

[30] Foreign Application Priority Data

May 15, 1996 [JP] Japan ..... 8-120010

[51] Int. Cl.[6] ..... G03G 15/00

[52] U.S. Cl. ..... 399/176; 399/313; 361/225; 492/56

[58] Field of Search ..... 399/174, 176, 399/313; 361/225; 492/56

[56] References Cited

U.S. PATENT DOCUMENTS 5,625,858 4/1997 Hirai et al. ..... 399/176

*Primary Examiner*—Joan H. Pendegrass

*Attorney, Agent, or Firm*—Fitzpatrick, Cella, Harper & Scinto

[57] ABSTRACT

The present invention pertains to a charging member which is energized to charge a chargeable member by contact-electrification and which comprises a conductive elastic layer having a surface layer containing a polymer having a main chain containing a structural unit of the following formula:

$$—O—(CH_2)_n—O—CO—$$

wherein n is an integer of from 4 to 10.

With stable charging properties, the charging member of the present invention has relatively uniform surface resistance, little dependency on the environmental conditions, and decreased contamination of photosensitive bodies and the like.

12 Claims, 2 Drawing Sheets

CHARGING MEMBER AND IMAGE-FORMING UNIT HAVING THE SAME

BACKGROUND OF THE INVENTION

1. Field of the Invention

The present invention relates to a charging member and an image-forming unit having the changing member. More particularly, the present invention relates to a charging member, which is energized and allowed to contact-electrify a chargeable body, and an image-forming unit having such a charging member.

2. Description of the Related Art

Conventionally, corona dischargers are utilized for charging the image-holding surface of a chargeable body such as a photosensitive body and a dielectric body in imageforming units such as electrophotographic apparatuses (e.g., copying machines and optical printers) and electrostatic recording apparatuses. The corona dischargers are advantageous in uniformly charging the an image-holding surface of a chargeable body to a predetermined electric potential. However, the corona dischargers have some problems such that they require a high-voltage source and the corona discharge is accompanied with disadvantageous ozone generation.

Contact-charging members, which are energized and allowed be in contact with chargeable bodies so as to charge the chargeable bodies, are superior to such corona dischargers because of a lower required voltage and reduced ozone generation. A chargeable body can be uniformly charged and prevention of leakage caused by pin-holes, defects, etc. on the surface of chargeable body such as a photosensitive body is achieved when the above-mentioned type of charging member has the following structure: at least two electrical resistance layers provided on a conductive support such that the external resistance layer maintains appropriate surface resistance and the internal resistance layer has appropriate elasticity for keeping a proper nip width with the chargeable surface.

Concerning the required properties of materials for the resurface layer having the above structure, for example, a transfer roller used for an image-forming unit in a copying machine is a member for transferring a toner image from an image-holding body, such as a photosensitive body, an intermediate transfer body, and a transfer drum, to transfer paper according to the following process: The transfer roller is pressed to the image-holding body having a developed toner image thereon. Toner on the image-holding body is thereby charged to the opposite polarity and absorbed by the transfer paper sandwiched between the image-holding body and the transfer roller. In this process, the density of charge supplied from the transfer roller to the transfer paper greatly affects the quality of the transferred toner image. In other words, when the surface of a transfer roller acquires a small charge-density due to an applied voltage having an opposite polarity to the toner, a charge-density secondarily generated on the surface of the transfer paper by the charge of the transfer roller also decreases. The above toner adsorption is thereby reduced. In particular, when very dry transfer paper is used, the charging density is further reduced. This is because such transfer paper has high resistance, and consequently, toner on the image-holding body cannot vertically be transferred to the transfer paper and a part of the toner adheres to portions not corresponding to the image, revealing a so-called "toner-splashing phenomenon".

Meanwhile, an exceedingly high charging density on the surface of a transfer roller leads to generation of an excessively high charging density on the surface of the transfer paper. As a result, toner on an image-holding body is charged to the opposite polarity, and thereby, the oppositely charged toner cannot vertically be transferred to the transfer paper and the resulting toner image is blurred, revealing a so-called "blurring phenomenon".

Furthermore, when the surface of a transfer roller has an uneven charging density, the charging density secondarily generated by the charge on the surface of the transfer paper is also uneven. Thus, toner on the image-holding body cannot uniformly be transferred to the transfer paper, revealing a so-called "uneven transfer phenomenon".

Moreover, high separating properties are required for transfer rollers so as to readily clean excess toner adhering to the rollers.

In addition, when toner on an image-holding body is strongly pressed by contact with a transfer roller, the toner is pressed to the image-holding body. As a result, the toner corresponding to the center of a line drawing in a transferred toner image formed on transfer paper cannot be transferred, revealing a so-called "blank area" caused by poor transfer. Therefore, in addition to a conductive elastic layer, softness of the surface layer is also required for transfer rollers.

From the above viewpoints, conventionally, polyamide is frequently used as a material for surface layers. However, polyamide has such disadvantages in that when used in a high-resistance region, the resistance of polyamide is raised by charge-buildup associated with intramolecular polarization, and furthermore, when used in highly humid environments, the resistance of polyamide decreases.

When polyester polyurethane is used as a material for a surface layer, it is reported that polyester polyurethane contaminates photosensitive bodies by hydrolysis. Although, polyether polyurethane does not cause hydrolysis, it has the following problems: the resistance characteristics of polyether polyurethane change according to the environment because of high hygroscopic properties; and polyether polyurethane sticks to the photosensitive bodies, etc. when pressed thereto for a long time duration.

SUMMARY OF THE INVENTION

It is an object of the present invention to provide a charging member that does not cause the splashing or blurring phenomenon. Another object of the present invention is to provide a charging member, which has little unevenness in the surface resistance so as not to cause the uneven transfer phenomenon. Still another object of the present invention is to provide a charging member having little change in resistance even under high humid environments. Additionally, another object of the present invention is to provide an electrophotographic apparatus and a process cartridge, both of which use such as the above charging member.

A charging member of the present invention is energized to charge a chargeable member by contact-electrification and it comprises a conductive elastic layer having a surface layer which contains a polymer having a main chain containing a structural unit of the following formula (1):

$$—O—(CH_2)_n—O—CO— \qquad \text{Formula (1)}$$

wherein n is an integer of from 4 to 10.

An image-forming unit of the present invention comprises the above charging member.

Since the molecular structure shown by formula (1) has free intermolecular rotation, the above polymer has excellent bending and flexibility, resulting in soft characteristics. Moreover, in the above polymer, charge-buildup responding to an applied voltage is low because intermolecular polarization of a bond in the polymer is smaller than that of an amide bond or the like. Furthermore, since the polymer has small intermolecular polarization, the hygroscopic properties accelerated by the hydrogen bond produced by the intermolecular polarization also becomes low. Therefore, the polymer has little change in resistance under highly humid environments. In addition, photosensitive bodies and the like will not become dirty because the polymer does not hydrolyze.

Fillers can relatively uniformly be dispersed in the polymer, since the polymer has low absorbance to the fillers.

The main chain of the polymer contains polymethylene as a hydrocarbon. Since polymethylene does not have intermolecular polarization and intermolecular rotation readily occurs, the resulting polymer exhibits excellent bending and decreased adhesion to a photosensitive body or the like.

A polymethylene chain has a polymerization degree n of 4 to 10. When n is more than 10, the strength of the polymer is reduced, thereby decreasing abrasion resistance and the like. When n is less than 4, hardness of the polymer increases due to a rise in crystallinity, thereby deteriorating softness.

DESCRIPTION OF THE PREFERRED EMBODIMENTS

Figure 1:
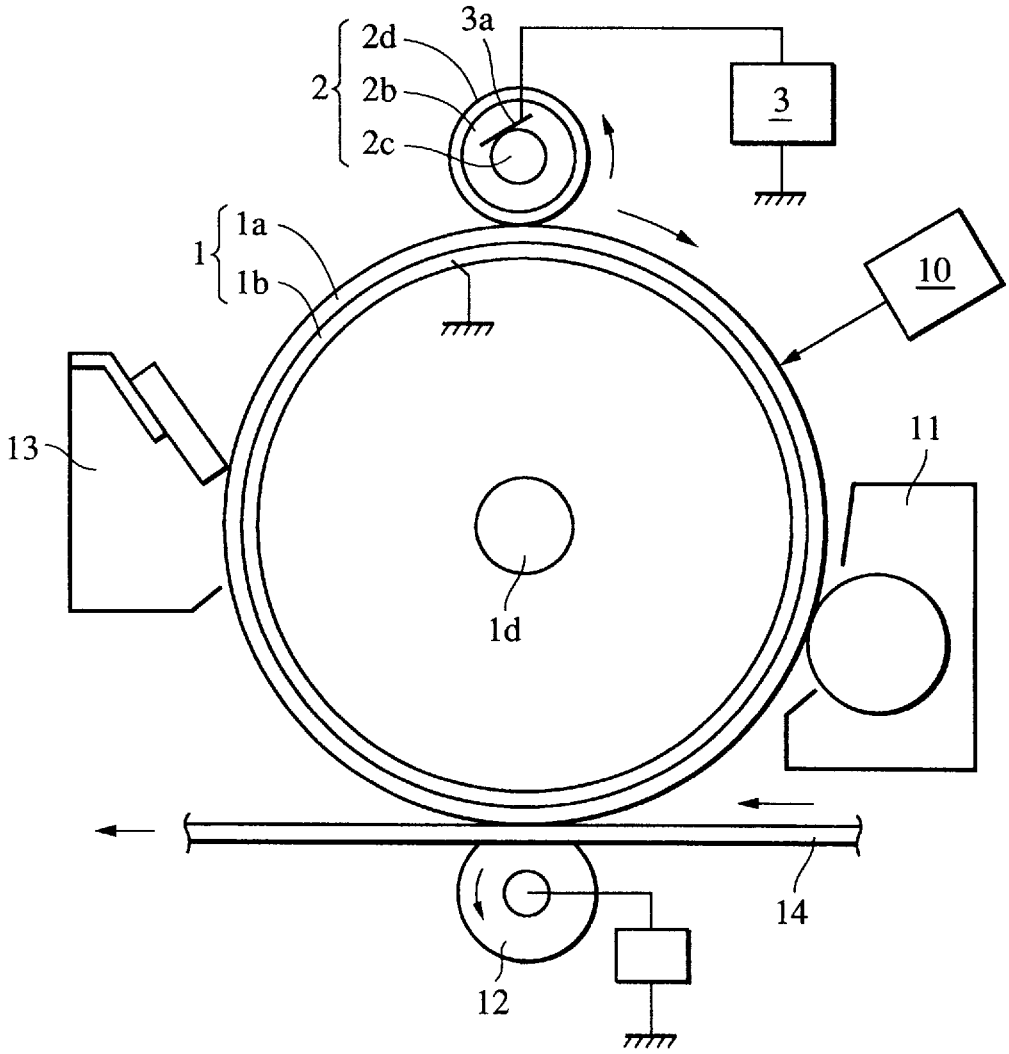
FIG. 1 is a diagram showing a structure of an electrophotographic apparatus equipped with a charging member incorporated in the present invention.

The following is a representative method for synthesizing a polymer forming the surface layer of a charging member incorporated in the present invention.

A divalent saturated fatty alcohol such as 1,4-butanediol, 1,6-hexanediol, or 1,8-octanediol and an alkyl carbonate such as diethyl carbonate or ethylene carbonate are polymerized by so-called ester-interchange. If required, the resulting polycarbonate diol is further subjected to reaction with an isocyanate such as hexamethylene diisocyanate or 4,4'-dicyclohexane diisocyanate or a divalent fatty acid such as terephthalic acid, adipic acid, or sebacic acid.

In addition, the surface layer acquires elasticity due to reaction between the polymer and an isocyanate such that the main chains of the polymer are crosslinked by urethane bonds. Therefore, the surface layer can follow deformation of the conductive elastic layer in an excellent manner and maintains superior flexibility even when large amounts of fillers are packed in a net-shaped polymer.

It is preferred that the surface layer has uniform resistance. This is because even if the conductive state of the conductive elastic layer is nonuniform, the surface layer can even-out the conditions. When a charging member is in a nonuniform conductive state, it is difficult to achieve an excellent image because of a nonuniform charge state.

The resistance of the surface layer is preferably from $1\times10^{13}$ to $1\times10^{16}$ Ω.cm. When the resistance is less than $1\times10^{13}$ Ω.cm, harmful effects occur within the surface layer due to an excessive amount of conductive current. For example, when such a surface layer is used in a transfer roller, a de-electrifying pin is set up for separating a transfer medium such as paper from the roller. In general, the polarity of applied voltage is opposite to that of the transfer roller. Therefore, when the surface layer has low resistance, a current flows from the transfer roller to the de-electrifying pin due to discharge and results in inferior transference due to a voltage loss. When resistance exceeds $1\times10^{16}$ Ω.cm, the insulating properties increase, and thus the required voltage for charging the transfer medium cannot be obtained. In the above-mentioned resistance range, conductive particles may be dispersed in the surface layer materials so as to increase the dielectric constant. In particular, when a dc voltage is applied, the resistance is elevated by charge-buildup, however, when conductive particles are appropriately dispersed in the material, the dielectric constant can be raised without affecting the resistance value, thereby suppressing the resistance elevation. However, when the conductive particles are nonuniformly dispersed, electric charge concentrates to the aggregated conductive particles and causes partial discharge, resulting in an inferior image. Although, many materials can be appropriately used as conductive particles, a metallic oxide essentially consisting of tin oxide such as $SnO_2.Sb_2O_5$ is preferably employed because of excellent dispersibility.

Figure 3:
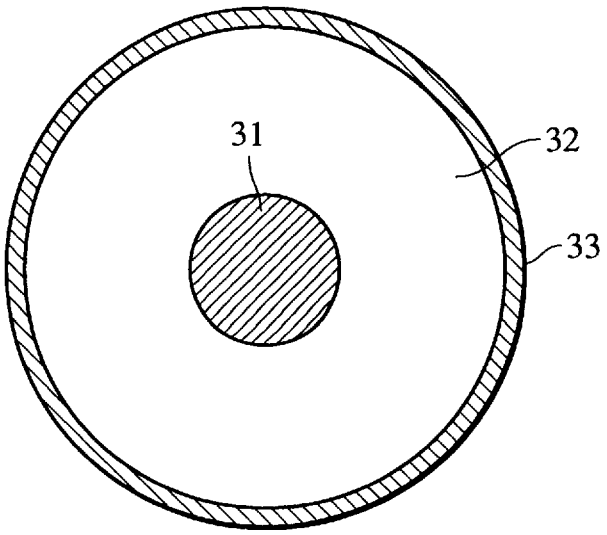
FIG. 3 is a sectional diagram showing a transfer roller as an example of a charging member incorporated in the present invention.

The present invention will be explained in further detail with reference to the accompanying drawings. FIG. 3 is a sectional diagram showing a structure of a transfer roller of the present invention. The transfer roller of this embodiment has the following structure: a conductive elastic layer 32 is provided on a conductive cylindrical support 31 made of metal, etc., and a surface layer 33 is further provided thereon.

Any conductive elastic layer can be used, as long as it can apply a transfer bias voltage to a transfer medium, such as paper, and it has elasticity enabling uniform pressing onto the transfer medium; and those having a volume resistance of from $1\times10^{5}$ to $1\times10^{12}$ Ω are preferably used in the present invention.

As an elastic body for a conductive elastic layer, the following polymer materials may be used: rubber such as EPDM (ethylene-propylene-diene-terpolymer), polybutadiene rubber, natural rubber, polyisoprene rubber, SBR (styrene-butadiene rubber), CR (chloroprene rubber), NBR (nitrile-butadiene rubber), silicone rubber, urethane rubber, and epichlorohydrin rubber; polystyrenes such as RB (butadiene resin) and SBS (styrene-butadiene-styrene elastomer); polyolefin; polyester; polyurethane; PE (polyethylene); PP (polypropylene); PVC (polyvinyl chloride); acrylic resin; styrene-vinyl acetate copolymer; butadiene-acrylonitrile copolymer; and the like. Among these, EPDM is most preferable because it does not readily deteriorate nor become dirty, and also, it is available at a relatively low price. The elastic body may be used as either a foamed or a solid body. However, the foamed body is preferable for insuring sufficient nip width with a chargeable body to achieve uniform charging.

Conductive elastic bodies can be prepared from the above elastic bodies such that resistance of the elastic bodies is adjusted to the desired value by appropriately dispersing the following materials in the elastic bodies: conductive particles of graphite, metallic oxides such as $TiO_2$, $SnO_2$, $Sb_2O_5$, and ZnO, metals such as Cu and Ag; conductive particles prepared by coating with these materials; and ionic electrolytes such as $LiClO_4$, KSCN, NaSCN, LiSCN, $LiCF_3SO_3$. Furthermore, it is also possible to obtain a conductive elastic body by introducing a polar molecule or atomic group into the main chain or a side chain of a polymer or by introducing a molecule or atomic group forming an ion pair into the main chain or a side chain of a polymer.

Among these materials, semiconductive EPDM sponge is preferably used, which is prepared by kneading EPDM with a $ZnO.Al_2O_3$ solid solution, carbon black, paraffin oil, a foaming agent, and a vulcanizing agent, followed by heating and foaming. Advantageously, EPDM has excellent resistance to deterioration without requiring additives such as an anti-oxidant. Moreover, resistance in a semiconductive region can be stabilized by using $ZnO.Al_2O_3$ and carbon black in combination. Furthermore, since an insulating oil, such as paraffin oil, can be employed as a process oil, the oil hardly affects the image, even when it oozes out on the photosensitive body.

FIG. 1 is a diagram showing a structure of an electrophotographic apparatus equipped with a charging member incorporated in the present invention. A drum-shaped electrophotographic photosensitive member 1 is employed as an image-holding body, i.e. chargeable body, and is composed of a conductive support 1*b* made of aluminum etc. and a photosensitive layer formed on the outer-peripheral surface of the conductive support 1*b*. The electrophotographic photosensitive member 1 is rotary-driven in a clockwise direction around an axis 1*d* at a predetermined peripheral velocity.

A roller-shaped charging roller 2 (hereinafter referred to as "charging roller") uniformly primary-charges the surface of the electrophotographic photosensitive member 1 to a predetermined electric potential with predetermined polarity by contact-electrification. The charging roller 2 is composed of a central metal core 2*c*, a lower resistance layer 2*b* formed peripherally around the central metal core 2*b*, and an upper resistance layer 2*d* formed peripherally around the lower resistance layer 2*b*. Both edges of the charging roller 2 are held by a pressing means (not shown in the figure) so that the charging roller 2 is rotated by the rotation of the photosensitive member 1.

The peripheral surface of the rotating photosensitive member 1 is contact-electrified to a predetermined electric potential with predetermined polarity by applying a predetermined DC bias or DC plus AC bias to the central metal core 2*c* from a power supply 3 via a slide regulator 3*a*. The peripheral face of the photosensitive member 1 uniformly charged by the charging roller 2 is then subjected to light exposure (e.g., laser-beam-scanning exposure or slit exposure of the original image) of target image information by an image exposure means 10 so that an electrostatic latent image corresponding to the target image information is formed on the peripheral surface.

The resulting electrostatic latent image is then visualized as a toner image by a developing means 11. By a transfer means 12, the resulting toner image is transferred to the surface of a transfer medium 14, which is fed from a feeding section (not shown in the figure) to a transfer section positioned between the photosensitive member 1 and the transfer means 12 in synchronization with the rotation of the photosensitive member 1. In this embodiment, a transfer roller is used as the transfer means 12 and charges the transfer medium 14 to opposite polarity to the toner from the back side of the transfer medium 14. The toner image on the surface of the photosensitive member 1 is thereby transferred to the surface side of the transfer medium 14.

The transfer medium 14 to which the toner image has been transferred is separated from the surface of the photosensitive member 1, introduced into an image-fixing means (not shown in the figure) in which the image is fixed, and fed out from the unit as a copy. In the case of image-forming also on the back side of the transfer medium 14, the resulting copy is fed to a retransfer means and back to the transfer section.

After transferring the image, adhered debris such as toner left on the surface of the photosensitive member 1 is cleaned by a cleaning means 13 and then the cleaned photosensitive member 1 is repeatedly used for image-forming.

Although the charging roller 2 is used as a charging means for the photosensitive member 1 of the image-forming unit shown in FIG. 1, the charging member can be formed into other shapes, such as a blade, a block, and a belt.

The charging roller 2 may be driven by the movement of the photosensitive member 1, may be rotatory-driven at a predetermined peripheral velocity in a forward or reverse direction with respect to the movement of the photosensitive member 1, or may be nonrotated. The charging member incorporated in the present invention can be used as the charging roller 2 and/or the transfer means 12.

The following structure is an example of a photosensitive member: A photosensitive layer is formed on a conductive support. Conductive material such as aluminum, an aluminum alloy, stainless steel, and nickel can be used as a support. Furthermore, a plastic support having a film formed by vacuum-depositing aluminum, an aluminum alloy, an alloy of indium oxide-tin oxide, or the like; a plastic or metallic support coated with conductive particles (e.g. carbon black or tin oxide particles) with an appropriate binder; and a plastic support containing conductive binder can be used.

An undercoating layer may be provided between a support and a photosensitive layer so as to work as a barrier and an adhesive between the layers. The following materials can be used for an undercoating layer: casein, polyvinyl alcohol, nitrocellulose, ethylene-acrylic copolymers, polyamides (e.g., nylon 6, nylon 66, nylon 610, and nylon copolymers), polyurethanes, gelatin, aluminum oxide, and the like. The thickness of the undercoating layer is preferably 5 $\mu$m or less and, more preferably, 0.5 $\mu$m to 3 $\mu$m. The undercoating layer preferably has a resistance of not less than $1\times10^7$ $\Omega$.cm to satisfactorily exhibit its functions.

A photosensitive layer can be formed from an organic or inorganic photoconductive substance by coating or deposition. For coating, a binder resin can also be employed with an organic or inorganic photoconductive substance as needed. Multi-layer types are preferably employed, according to which a photosensitive layer is functionally separated into a charge generation layer and a charge transport layer.

A charge generation layer can be formed by deposition or coating using a photoconductive substance such as an azo pigment, a phthalocyanine pigment, or a quinone pigment. For coating, an appropriate binder resin may also be employed with an organic or inorganic photoconductive substance as needed.

The thickness of the charge generation layer is preferably 0.01 to 5 $\mu$m and, more preferably, 0.05 to 2 $\mu$m.

A charge transport layer can be prepared by dissolving a charge transport material such as a hydrazone compound, a styryl compound, an oxazole compound, or a triarylamine compound in a binder resin having film-formability. The thickness of the charge transport layer is preferably 5 to 50 $\mu$m and, more preferably, 10 to 30 $\mu$m. A protective layer may be provided on the photosensitive layer for avoiding deterioration due to ultraviolet rays or the like.

Image exposure is carried out as follows: the original is read and converted to signals using reflected light or transmitting light, and then based on the resulting signals, laser-beam scanning, LED array driving, or liquid crystal shutter array driving is performed.

A charging member of the present invention can be used not only as a transfer, a primary charging, and a charge-removal means but also as a feeding means such as a paper supplying roller.

A charging member of the present invention can be used for electrophotographic apparatuses, such as copying machines, laser beam printers, LED printers, and electrophotographic application apparatuses including electrophotolithographic systems.

In the present invention, a plurality of components of an electrophotographic apparatus such as a photosensitive member, a charging member, a developing means, and a cleaning means as shown in FIG. 1 may be integrally assembled into a process cartridge so that the cartridge may be detachably mountable to the main body of the apparatus. For example, a charging member of the present invention and at least one of a developing means and cleaning means, as needed, can be integrally assembled with a photosensitive member into one process cartridge and the resulting cartridge is made detachable from the main body of the apparatus using a guiding means such as a rail set up on the main body.

Figure 2:
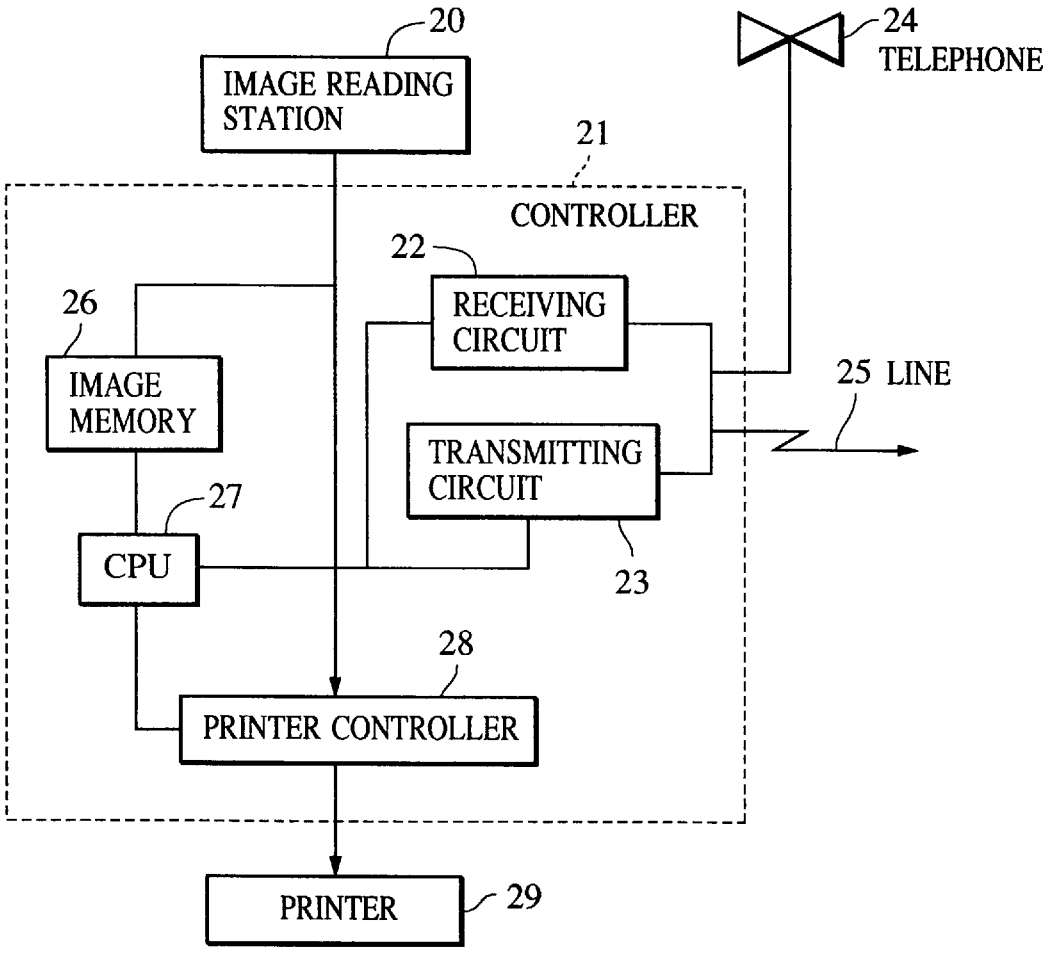
FIG. 2 is a block diagram of a facsimile employing an electrophotographic apparatus equipped with a charging member of the present invention as a printer.

When an electrophotographic apparatus of the present invention is employed as a printer of a facsimile, the image exposure light 10 is used as exposure light for printing the received data. FIG. 2 is a block diagram showing an example of such a case. A controller 21 controls an image reading station 20 and a printer 29. The controller 21 as a whole is controlled by a CPU 27. The read data from the image reading station 20 are transmitted to a remote station via a transmitting circuit 23. Data from the remote station are sent to the printer 29 via a receiving circuit 22. Prescribed image data are recorded in an image memory 26. A printer controller 28 controls the printer 29. A telephone is indicated by the reference numeral 24.

Image information received from a circuit 25 (image information from a remote terminal connected via a line) is demodulated by the receiving circuit 22, decoded by the CPU 27, and then sequentially stored in the image memory 26. When at least one image page is stored in the image memory 26, the CPU 27 reads out image information of the stored page from the image memory 26 and transmits the decoded image information of the page to the printer controller 28. When the printer controller 28 receives the image information of the page from the CPU 28, it controls the printer 29 so as to print the image information of the page. The CPU 27 receives image information of the next page while the printer 29 is printing. Receiving and printing images are carried out as the above.

Practical examples of the present invention will be described below. These examples illustrate certain preferred embodiments and are not limitative of scope. The term "part" used in the following examples represents a part by weight and the term "wt %" used in those examples represents % by weight.

EXAMPLE 1

FIG. 3 is a sectional diagram of a transfer roller of Example 1. There is shown a surface layer 33, a conductive elastic layer 32, and a cylindrical conductive support 31 in the figure.

According to Example 1, the conductive elastic layer 32 was a foamed EPDM rubber layer prepared as follows: With respect to 100 parts of EPDM, 60 to 150 parts of $ZnO.Al_2O_3$, 30 to 80 parts of carbon black, 30 to 80 parts of paraffine oil, and 5 to 15 parts of ADCA (azodicarbodiamide) which was used for foaming the rubber during vulcanization were added. The resulting rubber was formed into a tube by extrusion-forming, and foamed by primary vulcanizing according to steam vulcanization, followed by secondary vulcanization in an electric furnace. A cylindrical conductive support was pressed into the resulting tube-shaped conductive elastic layer 32 and then the surface of the layer was polished. The total resistance of the conductive elastic layer 32 and the surface layer 33 was $3\times10^9$ Ω from the undermentioned measurement conducted after leaving the roller at 23° C. and 60% R.H. for one week. According to the measurement, a conductive rubber sheet ($1\times10$ to $1\times10^2$ Ω.cm) having a width of 10 mm and a thickness of 1.5 mm was rolled around the roller surface. The resistance was measured by applying a voltage of 1 kV to a metal core and the conductive sheet. The roller was 230 mm long and had a diameter of 20 mm.

An aqueous coating material was then prepared by dispersing a prepolymer in water by high-speed stirring, followed by chain-elongation using hexamethylenediamine. The prepolymer was obtained by crosslinking polycarbonate diol (hydroxyl value=56 and Mn=2,000) using HMDI (4,4'-dicyclohexylmethane diisocyanate) at a molar ratio of 1:1, which polycarbonate diol was synthesized from 1,6-hexanediol and ethylene carbonate having the following formula:

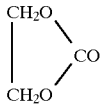

Moreover, a slurry was employed which was prepared by dispersing $SnO_2.Sb_2O_5$, as conductive particles, in water adjusted to pH 5.5 by an ammonia solution. The slurry was used at 5 wt % as a solid with respect to the resin contained in the above aqueous coating material. Although the conductive particles could uniformly be dispersed in the resin simply with a stirrer or the like, appropriate dispersing devices may be used.

The resulting coating material was applied to the surface of the sponge roller. Although, dipping was employed for coating in this example, other coating methods such as roll-coating and beam-coating can appropriately be used. The resistance of the coating film was $1\times10^{15}$ Ω.cm, which value was measured as follows: The coating material used for forming the surface layer was applied to an aluminum sheet followed by heating for drying. A 15 to 20 μm thick coating film was thereby obtained. The resulting sheet was sandwiched by electrodes having a diameter of 5 mm and then 100 V of dc voltage was applied to the electrodes to measure the coating sheet resistance.

Dipping was carried out such that the roller was pull up from the above coating material at 30 mm/sec to obtain a coating-film thickness of approximately 20 μm. The coated roller was dried at 120° C. for 30 min. The resistance of the roller was $1\times10^9$ Ω.

The resulting roller was used as the transfer roller 12 as shown in FIG. 1. Dry paper was used as the transfer medium 14. The processing speed of the copying machine was 100 mm/sec. The photosensitive drum was a negatively charged OPC (organic photo-conductor) and had a diameter of 30 mm. The toner was positively charged. An applied voltage of −5.7 kV and that of +1.5 kV were applied to the transfer roller during a transfer procedure and during a cleaning procedure, respectively.

A line-drawing, a solid black image, and a half-tone image obtained using the above roller revealed sharp images.

Using a solid black original of A4 size, 50 sheets of continuous copying was carried out on A5-size paper fed in the lengthwise direction. In the copying procedure, a cleaning bias voltage was applied during a non-transfer period and a transfer bias voltage was applied during a transfer period. After the continuous copying procedure, a sheet of A4 size was used for copying to evaluate toner contamination on the back side of the sheet. As a result, an image having no problems in practical use was obtained with very little toner contamination.

The above evaluation was carried out under a N/L condition (23° C. and 5% R.H.) and a H/H condition (35° C. and 85% R.H.), revealing similar results to the above.

Furthermore, neither peeling nor cracks were observed in the surface layer after a continuous durability test using three hundred thousand sheets.

In addition, a continuous copying was carried out on 10 sheets using a solid black image original under the N/L condition. As a result, uniform solid black images similar to an initial copy were obtained.

EXAMPLE 2

A coating material was prepared as a surface layer material such that 5 wt % of $SnO_2.Sb_2O_5$ was added to a MEK solution of a reaction product of polycarbonate diol (hydroxyl value=56 and Mn=2,000) of Example 1 and terephthalic acid, followed by dispersion using a sandmill. The resistance of the coating film was $1\times10^{14}$ Ω.cm. A roller was then produced according to a similar manner to Example 1.

The resulting roller was subjected to similar evaluation to Example 1, revealing similar results. Although micro cracks were observed in the surface layer after a continuous durability test using two hundred thousand sheets, there were no problems during practical use.

EXAMPLE 3

A transfer roller was produced according to a similar method to Example 1, except that 1,8-octanediol was employed instead of 1,6-hexanediol . The resulting transfer roller revealed similar characteristics to Example 1.

Comparative Example 1

A transfer roller was produced according to a similar method to Example 1, except that a solution of 20% nylon resin in methanol (trade name: AQ Nylon, manufactured by Toray Industries, Inc.) was employed as a surface layer material. The resistance of the coating film was $1\times10^{11}$ Ω.cm.

The resulting roller was subjected to similar image evaluation to Example 1. Consequently, a current flowing to the de-electrifying pin reduced the voltage, resulting in inferior transference due to a toner-splashing phenomenon. Lower resistance and further inferior transference resulted under the H/H condition as compared with that under the N/L condition. This was because the surface layer exhibited hygroscopic properties in high humid conditions.

What is claimed is:

1. A charging member for charging a chargeable member, said chargeable member being contact-electrified by said energized charging member, comprising:

a conductive elastic layer having a surface layer thereon;

said surface layer comprising a polymer having a main chain comprising a structural unit of the following formula:

$$—O—(CH_2)_n—O—CO—$$

wherein n is an integer of from 4 to 10.

2. A charging member as set forth in claim 1, wherein said polymer is crosslinked by urethane bonds.

3. A charging member as set forth in claim 1, wherein said surface layer comprises conductive particles and has a volume resistance of $1\times10^{13}$ to $1\times10^{16}$ Ω.cm.

4. A charging member as set forth in claim 3, wherein said conductive particles are a metallic oxide essentially consisting of tin oxide.

5. A charging member as set forth in claim 1, wherein said conductive elastic layer is a foamed body.

6. A charging member as set forth in claim 1, wherein said conductive elastic layer comprises EPDM.

7. An electrophotographic apparatus comprising a charging member and an electrophotographic photosensitive body;

said charging member comprising a conductive elastic layer having a surface layer thereon;

said surface layer comprising a polymer having a main chain comprising a structural unit of the following formula:

$$—O—(CH_2)_n—O—CO—$$

wherein n is an integer of from 4 to 10.

8. An electrophotographic apparatus as set forth in claim 7, wherein said charging member is a charging member for transferring.

9. An electrophotographic apparatus as set forth in claim 7, wherein said charging member charges said electrophotographic photosensitive body.

10. An electrophotographic apparatus as set forth in claim 7, wherein said polymer is crosslinked by urethane bonds.

11. A process cartridge comprising a charging member and an electrophotographic photosensitive body integrated as one body, said process cartridge being detachable from the main body of an image-forming unit;

said charging member comprising a conductive elastic layer having a surface layer thereon;

said surface layer comprising a polymer having a main chain comprising a structural unit of the following formula:

$$—O—(CH_2)_n—O—CO—$$

wherein n is an integer of from 4 to 10.

12. A process cartridge as set forth in claim 11, wherein said polymer is linked by urethane bonds.

* * * * *

UNITED STATES PATENT AND TRADEMARK OFFICE

CERTIFICATE OF CORRECTION

PATENT NO. : 5,819,142

DATED : October 6, 1998

INVENTOR(S) : JUN MURATA, ET AL.

It is certified that error appears in the above-identified patent and that said Letters Patent is hereby corrected as shown below:

COLUMN 1:

Line 15, "imageforming" should read --image-forming--;
Line 19, "the an" should read --the--;
Line 33, "structure:" should read --structure of--;
and
Line 41, "resurface" should read --surface--.

COLUMN 2:

Line 34, "Although," should read --Although--; and
Line 53, "such" should read --the above-described charging member--.

COLUMN 3:

Line 62, "even-out" should read --even out--.

UNITED STATES PATENT AND TRADEMARK OFFICE

CERTIFICATE OF CORRECTION

PATENT NO. : 5,819,142

DATED : October 6, 1998

INVENTOR(S) : JUN MURATA, ET AL.

It is certified that error appears in the above-identified patent and that said Letters Patent is hereby corrected as shown below:

COLUMN 8:

Line 47, "Although," should read --Although--; and
Line 58, "pull" should read --pulled--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,819,142
DATED : October 6, 1998
INVENTOR(S) : Jun Murata et al.

It is certified that error appears in the above-identified patent and that said Letters Patent is hereby corrected as shown below:

Title page,
Add:
-- [73] Assignee: Canon Kabushiki Kaisha --

Signed and Sealed this

Third Day of December, 2002

JAMES E. ROGAN
*Director of the United States Patent and Trademark Office*